United States Patent [19]

Romano

[11] Patent Number: 4,536,727

[45] Date of Patent: Aug. 20, 1985

[54] MULTIPLE POLE MERCURY SWITCH PARTICULARLY ADAPTED FOR THERMOSTAT APPLICATIONS

[75] Inventor: Robert P. Romano, Glen Ridge, N.J.

[73] Assignee: Comus International Corp., Nutley, N.J.

[21] Appl. No.: 616,653

[22] Filed: Jun. 4, 1984

[51] Int. Cl.[3] ..... H01H 29/22

[52] U.S. Cl. ..... 335/54; 337/331; 337/373; 200/220; 165/26

[58] Field of Search ..... 200/182, 183, 184, 187, 200/188, 189, 220, 224; 335/48, 54, 56; 337/373, 374, 375, 323, 331; 165/26

[56] References Cited

U.S. PATENT DOCUMENTS

| | | | |
|---|---|---|---|
| 3,193,645 | 7/1965 | Desjardins | 335/54 |
| 4,078,601 | 3/1978 | Kolbow | 165/26 |

*Primary Examiner*—E. A. Goldberg
*Assistant Examiner*—George Andrews
*Attorney, Agent, or Firm*—Arthur L. Plevy

[57] ABSTRACT

There is disclosed a mercury switch for use in thermostat applications. The switch has a hollow housing fabricated from glass and is positioned in the horizontal plane when in an operating orientation. The switch has a first common electrode within said housing and extending parallel to the horizontal plane with a terminal end extending from the housing. Positioned above the first electrode is a second shorter electrode with a third longer electrode positioned above said second electrode said third electrode being longer than said second but shorter than said first. Positioned above the third electrode is a longer fourth electrode. Essentially, major portions of the electrodes within the housing are parallel to each other. A charge of mercury is in the housing and operates to make contact between the electrodes in four operating modes indicative of thermostat operation for control of a heat pump, furnace and air conditioner. In a first mode the first electrode is in contact with the second to activate a furnace or air conditioner. In the second mode, based on a further tilt of the switch, the first electrode is in contact with the third to activate a heat pump. In the third mode the first electrode is in contact with the third and fourth to activate a heat pump and an air conditioner or furnace. In the fourth mode the first electrode is in contact with the fourth to activate the air conditioner or furnace. The switch is mounted on a bimetallic spring which expands and contracts to tilt the switch to cause the above noted operation.

20 Claims, 4 Drawing Figures

MULTIPLE POLE MERCURY SWITCH PARTICULARLY ADAPTED FOR THERMOSTAT APPLICATIONS

BACKGROUND OF THE INVENTION

This invention relates to mercury switches in general and more particularly to a unique mercury switch configuration exhibiting a single pole triple throw operation for use in a thermostat.

The mercury switch has been widely employed as a switching element in conjunction with thermostats. Particularly, mercury switches have been employed with bimettalic type thermostats of special configuration. In such devices, the mercury switch which is a single pole, single throw element is mounted on a bimetallic spiral spring, and as the bimetallic spiral spring expands or contracts with temperature changes, the switch is tiled to close a contact and turn on a furnace or other device.

In applications where air conditioning and furnace control are required, two or more such switches are employed. Mercury switches are widely employed, as tilt switches or detectors and are capable of reliable operation, while handling relatively large currents. As such, they have been employed in many applications as they are relatively inexpensive and extremely reliable. The bimetallic spiral is also widely employed in thermostats and essentially consists of two thin strips of different metals bonded together and forming a spiral spring element. The metals undergo different amounts of thermal expansion as one metal expands more than the other during temperature changes. This causes the bimetallic element to contract and expand accordingly and hence tilt the mercury switch during temperature changes to activate a heating or air conditioning unit to maintain the monitored temperature at a desired value.

While the thermostat application of mercury switches is widespread, there are many other applications in which such switches have been employed. Due to these factors, the prior art is replete with a number of patents and devices which employ multiple contact mercury switches for various applications. However, these devices, as will be seen, are not amenable to application for thermostatic control.

U.S. Pat. No. 1,880,832 entitled MERCURY SWITCH issued on Oct. 4, 1932 and depicts a mercury switch employing a plurality of electrodes which are disposed within a mercury filled bossed recess and used to activate an electrical sign.

Other patents as U.S. Pat. No. 2,927,987 entitled LEVEL SWITCHES by H. B. Uhl issued on Mar. 8, 1962 and depicts curved envelopes which include a pluarlity of electrodes used for motor control and other applications.

Various other patents as U.S. Pat. No. 2,508,986 entitled MERCURY SWITCH by C. A. Anderson issued on May 23, 1950 and depict momentary contact mercury switches. These devices require multiple electrodes and multiple recessed housings to afford controllable operation. Other switch types and devices are shown in U.S. Pat. No. 4,138,600 and U.S. Pat. No. 2,677,031.

Essentially, upon reviewing this type of art and other patents as well, one will ascertain that the devices employ complicated housing structures for control purposes such as multiple bossed or recessedhousings as well as complicated electrode structures.

It is, therefore, an object of the present invention to provide an improved mercury switch associated with multiple electrodes which is easy to construct and is particularly adaptable for thermostat control.

A further object of this invention is to provide an improved mercury switch for use in a thermostat which switch operates as a single pole triple throw device and which is simple to use and inexpensive to construct.

BRIEF DESCRIPTION OF THE PREFERRED EMBODIMENT

A mercury switch comprising a hollow housing of a longitudinal tubular configuration and when positioned in the horizontal plane having a first closed end and a base end with a first long electrode disposed in said housing and relatively parallel to said horizontal plane with said electrode extending from said base, a second shorter electrode positioned above said first electrode, within said housing and extending from said base, a third electrode above said second of a length longer than said second and shorter than said first positioned in said housing and extending from said base, and a fourth electrode positioned above said third and of a length longer than said third electrode and extending from said base, with a charge of mercury in said housing hollow such that when said switch is tilted with respect to said plane said mercury can alternately make contact in four distinct modes, wherein a first mode contact is made between said first and second electrodes, in a second mode contact is made between said first and third electrodes, in a third mode contact is made between said first, third and fourth electrodes and in a fourth mode contact is made between said first and fourth electrodes.

DETAILED DESCRIPTION OF THE FIGURES

Before proceeding with a detailed description of the figures, a few brief points about modern heating and air conditioning systems are believed to be warranted.

In many applications the thermostat is used to control a furnace or heat strip as well as a heat pump and an air conditioning unit. Essentially, the heat pump is becoming very popular and is widely employed. Thus such modern thermostats require a mode of operation where both the air conditioner and heat pump will be operating. In order to accommodate such operation, the prior art employed bimetallic devices as indicated above together with multiple mercury switches to implement such control. It is, of course, understood that the use of multiple switches increased the cost of the thermostat as well as reduced the reliability.

Figure 1:
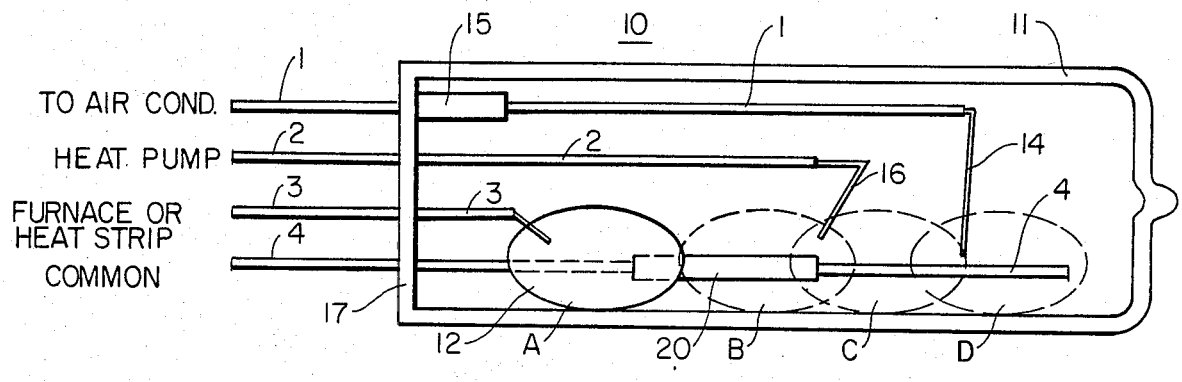
FIG. 1 is a side elevational view of a mercury switch according to this invention.

Referring to FIG. 1, there is shown a mercury switch 10 according to this invention.

Essentially, the switch 10 comprises a glass or other suitable housing 11 such as those conventionally employed in modern day switches. Hence housing 11 is glass and fabrication of such housing is well known. It is also known that mercury will not wet glas but forms a convex globule when emplaced on glass. Hence contained within the housing 11 is a charge or globule of mercury 12. The housing 11 is associated with four electrodes designated as 1, 2, 3, and 4. As seen in FIG. 1, electrode 1 is positioned near a top surface of the housing and is an elongated member fabricated from an alloy of nickel and platinum and terminates in a ninety degree bend manifesting a contact 14. The inner area of the electrode 1 within the housing 11 has a cylinder of insulative material 15 disposed about the same. This cylinder of material 15 is to prevent improper contact during switch over tilt as will be further explained. Positioned below electrode 1 is a shorter electrode 2, which is also fabricated from a nickel-platinum alloy and is terminated in a contact 16 which is directed back towards the base 17 of the housing 11 at an angle between 30°-60° with 45° being preferable. Positioned below electrode 2 is still a shorter electrode 3 which is directed at an angle between 30°-60° of opposite orientation to the angle associated with electrode 2. This angle is also preferably 45°. Positioned beneath electrode 3 is a common electrode which electrode is at least as long as electrode 1. The electrode 4 is also fabriacted from a nickel-platinum alloy and has a sleeve or cylinder of nickel 20 positioned thereon in an area underlying electrode 2 and the associated contact 16.

Each of the electrodes 1-4 are directed from the base 17 of glass housing to serve as terminals. As indicated in FIG. 1, contact 1 is used to control an air conditioning unit when contact is made by the mercury globule 12 between contact 1 and contact 4. Contact 2 is used to control a heat pump, contact 3 to control a furnace or heat strip and contact 4 is the common contact. The switch 10 is positioned in operation in the orientation shown in FIG. 1. It is noted that a large portion of the electrodes as located within the housing are parallel to each other, with electrode end portions as 14, 16 extending downwardly toward the common electrode 4.

Figure 3:
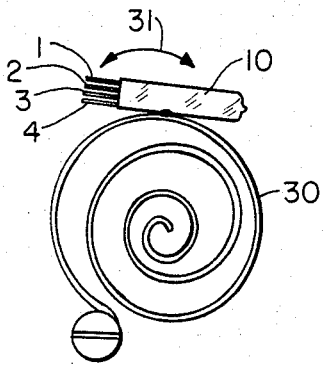
FIG. 3 is a simple view showing a bimetallic element and the switch.

Operation is as follows. Referring first to FIG. 3, there is shown the switch 10 secured to the surface of a spiral bimetallic spring 30 of the type employed in the thermostat. As above indicated, during temperature changes, the spring 30 will expand and contract causing the switch 10 to tilt with respect to the horizontal plane as shown by arrow 31.

When the switch 10 is in the position shown with the electrodes 1-4 relatively parallel to the horizontal axis, the mercury globule 12 causes the furnace or heat strip to be activated or turned on and the furnace will remain on until the switch is further tilted downward (FIG. 3). The globule 12 travels along the electrode 4 and is slowed in movement by the nickel sleeve 20 where it will assume a position (B) making contact with electrode 2 via contact 16. This position (B) causes the heat pump to operate. Thus for a given range of angles indicative of a given temperature range the heat pump will be operated due to the connection between the common electrode 4 and electrode 2. For further changes in temperature, the switch is again tilted further so that the mercury globule 12 will now assume position C. In this position the globule 12 contacts electrodes 1 and 2 and 4. Hence in this position C the switch causes the air conditiner and the heat pump to operate. In position D the globule is in contact with electrodes 1 and 4 causing the air conditioner to operate. The angles employed on electrodes 3 and 2 assure reliable contact with the mercury globule. If there is an external over tilt, as for example, the switch being held vertically then the globule 12 will fall to the base and cause the air conditioner, heat pump and furnace to turn on, this, of course, is not acceptable, so the insulator sleeve 15 prevents contact in an overtilt mode with electrode 1. The activation of the furnace and heat pump is not a problem.

Figure 2:
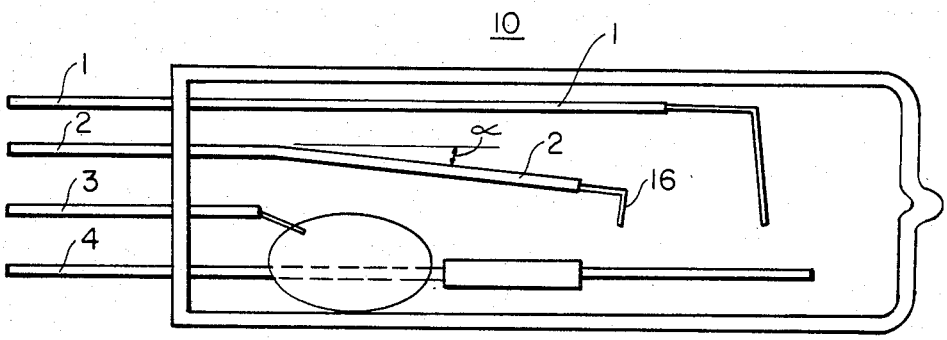
FIG. 2 is an alternate embodiment of the switch.

In FIG. 2 there is shown an alternate embodiment of the switch 10, wherein electrode 2 is directed at an angle A of about thirty degrees. This is done to assure more reliable operation and control.

Figure 4:
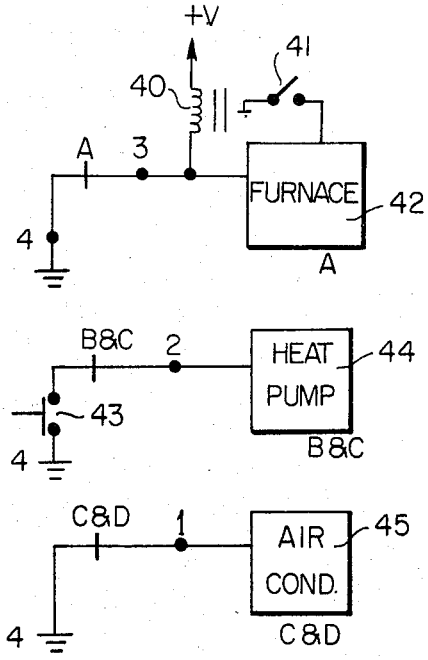
FIG. 4 is a series of simple schematic diagrams showing the various modes of operation for the switch used in a thermostat.

Referring to FIG. 4, there is shown a series of simple schematics depicting the control sequences described above.

Hence the top Figure shows mode A operation where electrode 3 is in contact with electrode 4. A relay coil 40 maybe operated to close contact 41 and turn on the furnace 42.

In modes B and C, the electrode 2 is in contact with the common electrode 4, thus causing the heat pump 44 to be activated. It is seen that a further switch 43 can be employed in the thermostat circuit so that the heat pump can be manually switched off.

In modes C and D, electrode 1 is in contact with electrode 4 causing the air conditioner 45 to be activated. It is, of course, understood that in colder climates, electrode 1 would control the furnace instead of the air conditioner. It is further noted that with the use of the above mercury switch, one can design the thermostat for three distinct modes of operation as Summer (cooling), Spring/Fall (heat-pump plus furnace or air conditioning, Winter (furnace).

Essentially, the above noted switch is simple to construct and is reliable in operation. A typical switch as 10 is approximately 1.75 inches in length (glass housing), 0.407 inches in diameter. The electrodes are spaced from center to center at 0.0875 inches. The internal hollow of the switch is backfilled with hydrogen at a pressure of less than 1 atmosphere and there is about a 1.5 degree angle of operation between modes as A, B, C and D. the single switch described above is mounted to a bimetallic spring or other device (FIG. 3) and replaces the use of multiple switches as employed in the prior art.

I claim:

1. A mercury switch comprising a hollow housing of a longitudinal tubular configuration and when positioned in the horizontal plane having a first closed end and a base end with a first long electrode disposed in said housing relatively parallel to said horizontal plane with said electrode extending from said base, a second shorter electrode positioned above said first electrode, within said housing and extending from said base, a third electrode above said second of a length longer than said second and shorter than said first positioned in said housing and extending from said base, and a fourth electrode positioned above said third electrode and extending from said base, with a charge of mercury in said housing hollow such that when said switch is tilted with respect to said plane, said mercury can alternately make contact in four distinct modes, where in a first mode contact is made between said first and second electrodes, in a second mode contact is made between said first and third electrodes, in a third mode contact is made between said first, third and fourth electrodes and in a fourth mode contact is made between said first and fourth electrodes.

2. The mercury switch according to claim 1 wherein said housing is glass having a sealed first closed end and a base end sealed about said extending electrodes.

3. The mercury switch according to claim 1 wherein said electrodes are fabricated from a nickel platinum alloy.

4. The mercury switch according to claim 1 wherein said housing hollow is filled with hydrogen at a pressure of less than 1 atmosphere.

5. The mercury switch according to claim 1 wherein said first electrode further includes a sleeve of nickel positioned about said first electrode within said hollow and underlying an area of said third electrode.

6. The mercury switch according to claim 1 wherein said second electrode has a first portion within the housing parallel to said first electrode and an angled contact portion directed towards said first electrode.

7. The mercury switch according to claim 6 wherein said angle is between 30 to 60 degrees.

8. The mercury switch according to claim 6 wherein said third electrode has a first portion relatively parallel to said first electrode and an angled contact portion directed towards said first electrode of an opposite slope than that angle of said second electrode.

9. The mercury switch according to claim 8 wherein said angle of said third electrode is between 30 to 60 degrees.

10. The mercury switch according to claim 1 wherein said fourth electorde has a first portion parallel to said first electrode and a second contact portion extending downwardly towards said first electrode.

11. The mercury switch according to claim 10 wherein a portion of said first portion of said fourth electrode nearest said base end of said housing is covered by an insulator.

12. A thermostat employing a mercury switch in combination comprising:

a bimetallic spiral element capable of contracting and expanding according to temperature changes and having mounted thereon, A mercury switch comprising a hollow housing of a longitudinal tubular configuration and when positioned in the horizontal plane having a first closed end and a base end with a first long electorde disposed in said housing relatively parallel to said horizontal plane with said electrode extending from said base, a second shorter electrode positioned above said first electrode, within said housing and extending from said base, a third electrode above said second of a length longer than said second and shorter than said first positioned in said housing and extending from said base, and a fourth electrode positioned above said third electrode and extending from said base, with a charge of mercury in said housing hollow such that when said switch is tilted with respect to said plane, said mercury can alternately make contact in four distinct modes, where in a first mode contact is made between said first and second electrodes, in a second mode contact is made between said first and third electrodes, in a third mode contact is made between said first, third and fourth electordes and in a fourth mode contact is made between said first and fourth electrodes.

13. The combination according to claim 12 wherein said first electrode is a common electrode.

14. The combination according to claim 13 wherein said second electrode is adapted to be coupled to the control circuit of a furnace.

15. The combination according to claim 14 wherein said third electrode is adapted to be coupled to the control circuit of a heat pump.

16. The combination according to claim 15 wherein said fourth electrode is adapted to be coupled to the control circuit of an air conditioner.

17. The combination according to claim 12 wherein said second electrode is adapted to be coupled to the control circuit of an air conditioner.

18. The combination according to claim 17 wherein said fourth electrode is adapted to be coupled to the control circuit of a furnace.

19. The combination according to claim 12 wherein said housing is fabricated from glass with said electrodes fabricated from a nickel-platinum alloy.

20. The combination according to claim 19 wherein said first electrode has a portion covered with a nickel sleeve within said housing.

* * * * *